US005656043A

United States Patent [19]

Döbbeling

[11] Patent Number: 5,656,043

[45] Date of Patent: Aug. 12, 1997

[54] PROCESS FOR AIR-BLOWN GASIFICATION OF CARBON-CONTAINING FUELS

[75] Inventor: Klaus Döbbeling, Nussbaumen, Switzerland

[73] Assignee: ABB Research Ltd., Zurich, Switzerland

[21] Appl. No.: 421,251

[22] Filed: Apr. 13, 1995

[30] Foreign Application Priority Data

May 19, 1994 [DE] Germany ..... 44 17 539.6

[51] Int. Cl.[6] ..... C10L 3/00

[52] U.S. Cl. ..... 48/197 R; 48/108; 48/206

[58] Field of Search ..... 48/191 R, 202, 48/206, 214, 215, DIG. 4, 94, 95, 61, 108; 252/373

[56] References Cited

U.S. PATENT DOCUMENTS

| | | | |
|---|---|---|---|
| 1,530,281 | 3/1925 | Murrie | 48/DIG. 4 |
| 1,963,167 | 6/1934 | Heller | 48/94 |
| 2,010,634 | 8/1935 | Hillhouse | 48/DIG. 4 |
| 2,011,339 | 8/1935 | Hillhouse | 48/DIG. 4 |
| 2,028,946 | 1/1936 | Niconoff | 48/DIG. 4 |
| 2,038,657 | 4/1936 | Hillhouse | 48/DIG. 4 |
| 2,077,236 | 4/1937 | Harris | 48/94 |
| 2,085,510 | 6/1937 | Rider | 48/94 |
| 2,656,264 | 10/1953 | Yellott | 48/206 |
| 2,684,896 | 7/1954 | Coghlan | 48/215 |
| 2,920,945 | 1/1960 | Totzek | 48/206 |
| 3,009,795 | 11/1961 | Atwell | 48/206 |
| 4,150,953 | 4/1979 | Woodmansee | 60/39.12 |
| 4,490,157 | 12/1984 | Feinandes | 48/62 R |
| 4,731,989 | 3/1988 | Furuya et al. | 60/39.05 |
| 4,737,161 | 4/1988 | Szydlowski | 48/61 |
| 5,441,546 | 8/1995 | Moard et al. | 48/61 |

FOREIGN PATENT DOCUMENTS

| | | | |
|---|---|---|---|
| 2920425 | 11/1979 | Germany . | |
| 3904712A1 | 8/1990 | Germany . | |
| 4028853A1 | 3/1992 | Germany . | |
| 4335136 | 4/1994 | Germany | 60/39.464 |

*Primary Examiner*—Timothy McMahon
*Attorney, Agent, or Firm*—Burns, Doane, Swecker & Mathis, L.L.P.

[57] ABSTRACT

When carrying out a radiant heat exchange between two media, one medium being a hot gas (5) and the other medium being a gasification mixture (11) of fuel and steam, the device consists of a gasification vessel (1) which, for its part, consists of a reaction space (2), an intermediate tube (4) and a flow space (3). In the reaction space (2), the hot gases (5) flow away centrally in the direction of the intermediate tube (4) and the flow space (3). The gasification mixture (11) flows in the opposite direction out of the flow space (3) and the intermediate tube (4). This gasification mixture surrounds the hot gases (5) in such a way that the radiant heat exchange takes place between the two media (5, 11).

4 Claims, 3 Drawing Sheets

PROCESS FOR AIR-BLOWN GASIFICATION OF CARBON-CONTAINING FUELS

BACKGROUND OF THE INVENTION

1. Field of the Invention

The present invention relates to an apparatus and a process for air-blown gasification of carbon-containing fuels involving heat exchange between endothermic and exothermic reactions.

2. Discussion of Background

For the gasification of coal or residue oil, use is currently made primarily of oxygen-blown processes, for example the Shell carbon gasification process. These processes produce a gas having a relatively high calorific value, 12–15 MJ/kg, which, owing to its low mass flow rates, can be desulfurized without large enthalpy loss and dedusted using washing devices. In this case the typical gasification reactions $$CH4+H2O \rightarrow CO+3HT \quad (1)$$

$$C+H2O \rightarrow CO+H2 \quad (2)$$

proceed endothermically.

The required energy is, for example, provided by exothermic reaction $$2C+O2 \rightarrow 2CO \quad (3a)$$

In this case, approximately 22% of the calorific value of the fuel is converted by the exothermic reaction (3*a*) first in two sheets and then, via the endothermic reactions (1) and (2) back into fuel enthalpy.

In the case of an air-blown gasification process according to the prior art, the exothermic reaction (3*a*) would become:

$$2C+O2+4N2 \rightarrow 2CO+4N2 \quad (3b)$$

and the calorific value of the product gases is reduced to less than 50% in comparison with oxygen-blown gasification.

An essential disadvantage of this process is the fact that the gasification product is contaminated with atmospheric nitrogen.

SUMMARY OF THE INVENTION

Accordingly, one object of the invention is to provide a novel process and gasification vessel of the type mentioned at the outset in which the energy required for the gasification of carbon-containing fuels is produced by an air-blown gasification process, without the gasification product being contaminated with atmospheric nitrogen.

The process is carried out with the aid of a gasification vessel in which a rotational stream is produced by the combustion. In this case a substoichiometric fuel/air mixture is axially burnt in a swirling-flow burner, essentially with the exothermic reaction (3*b*) proceeding. In the counterflow, fuel is also gasified in the outer radial region with highly superheated steam at 700°–1200° C. according to the endothermic reactions (1) and (2). The stable stratification in the cylindrical reaction space avoids the energy-delivering partial flow in the center, where a combustion temperature of approximately 1800° C. prevails, mixing with the fuel/steam mixture, which it is intended to gasify, in the outer radial region. The heat transfer from the energy-delivering partial flow to the mixture to be gasified takes place by direct radiant heat exchange, by indirect radiant heat exchange with the participation of the combustion-chamber wall and by convective heat transfer between the combustion-chamber wall which is heated by radiation and the gasification mixture. Following the gasification reactor, by virtue of the addition of secondary air, the central partial flow which has already so far yielded a large portion of its sensible heat to the fuel/steam mixture to be gasified, is fully burnt off.

An advantage of the invention resides in the fact that, by virtue of the two-stage combustion procedure, it is also possible to use fuels with nitrogen bound to the fuel, without obtaining high nitrogen oxide values in the exhaust gas.

A further advantage of the invention resides in the fact that the process is suitable for all fuels, in particular for liquid fuels, such as heavy oils, residue oils, orimulsion, or else for coal in the form of coal water slurry (CWS) or in the form of coal dust.

Further advantages of the invention are:

an air separation system is no longer required;

the process can be operated both atmospherically and under pressure;

a gasification product having a moderate calorific value≈10 MJ/kg is produced which can be burnt in a gas turbine with low pollutant emission.

Advantageous and expedient developments of the solution to the object of the invention are found in the other claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein all elements not necessary for direct understanding of the invention are omitted and the flow direction of the media is specified with arrows, and wherein.

DESCRIPTION OF THE PREFERRED EMBODIMENTS

Figure 1:
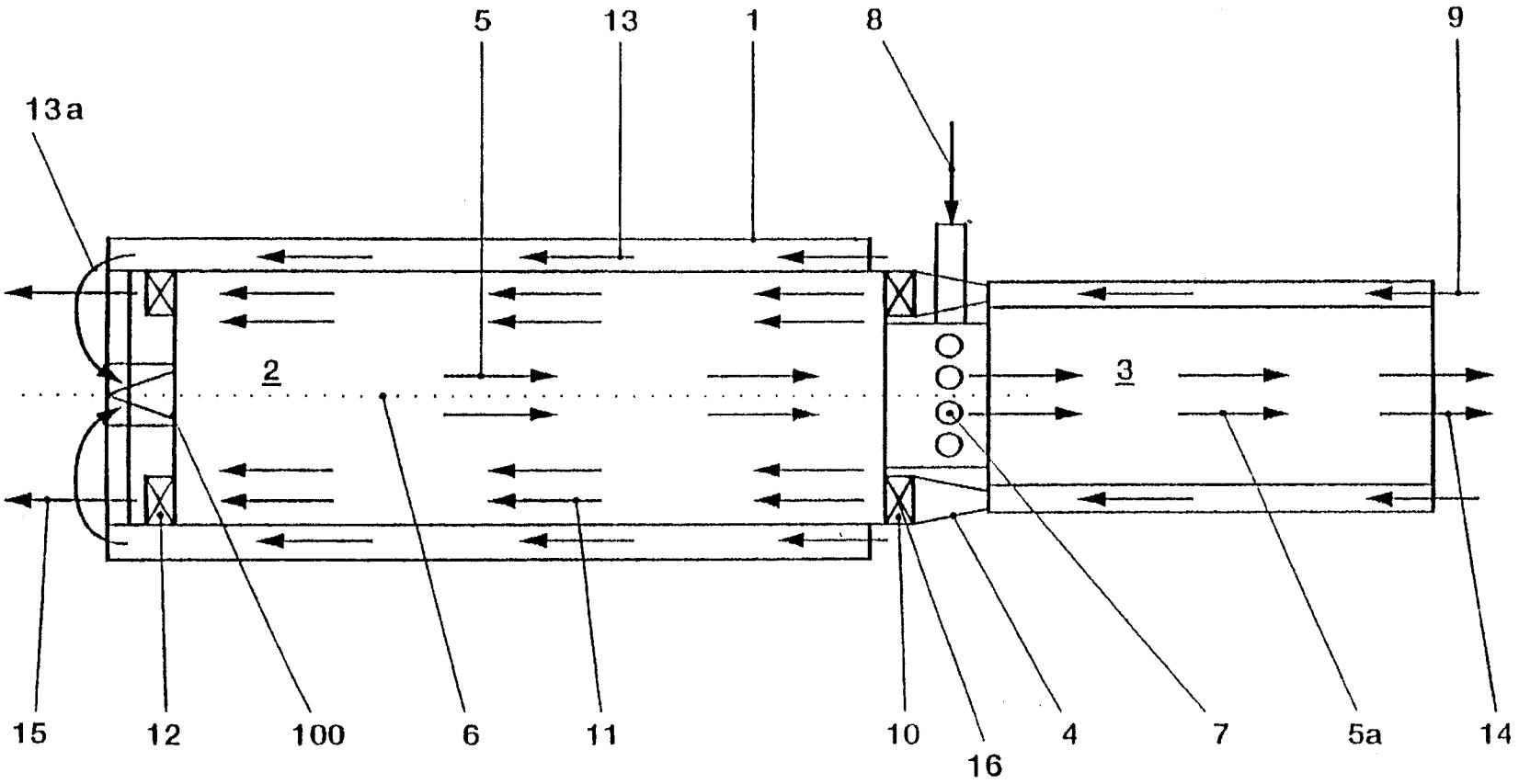
FIG. 1 shows a cylindrical gasification vessel in which a gasification product with a calorific value≈10 MJ/kg is prepared.

Referring now to the drawings, wherein like reference numerals designate identical or corresponding parts throughout the several views, FIG. 1 shows a cylindrical gasification vessel 1 which consists of a burner 100, a reaction space 2, a flow space 3 connected downstream in the flow direction of the hot gases and, connected therebetween, an intermediate tube 4. The burner 100 is preferably designed as a premix burner: in this regard reference will be made to the embodiments in FIGS. 2–5. The stated premix burner 100 which produces a stable hot-gas stream 5 in the core or center 6 of the reaction space 2 operates on the head side and at the center of the reaction space 2. These hot gases 5 flow so to speak bunched and under rotation through the reaction space 2. This flow through the center of the reaction space 2 is the essential energy source, the combustion temperature of which is approximately equal to 1800° C. The intermediate tube 4 has a number of orifices 7 arranged in the circumferential direction of the flow cross section, through which orifices secondary air 8 is admixed to the substoichiometric hot gases 5 flowing therethrough, the temperature of which gases is elevated by the reaction subsequently taking place, before these new hot gases 5*a* flow through the flow space 3 connected downstream. At the same time, this flow space 3 fulfills the function of a heat exchanger: a steam flow 9, the initial temperature of which is approximately equal to 150° C., is fed in annularly with respect to the flow space 3 in the counterflow direction to the hot gases 5*a*. This steam 9 is superheated along the heat-exchange section, before it flows through the intermediate tube 4. In contrast, the hot gases 5*a* cool to form exhaust gases 14 having a temperature of 500° C., at which they are best suited for the generation of steam to operate a steam turbine. Adjacent to the reaction space 2 located upstream, the annular orifice of the intermediate tube 4 has a series of rotation structures 10, with a fuel-injection nozzle, arranged in the circumferential direction, which produce a mixture of fuel and superheated steam, hereinbelow referred to as the gasification mixture 11, on which a rotating motion is imposed. In the reaction space 2, in the counterflow direction, this rotating motion surrounds the central stream of hot gases 5 in such a way that heat transport between the two media takes place, without mutual exchange and without physical separation, as is the case with heat exchangers. This gasification mixture 11 leaves the reaction space 2 as gasified fuel 15 having a calorific value<10 MJ/kg and having a temperature of approximately 650° C., the rotational motion existing after and before being increased by further rotation structures 12 placed at the end of the reaction space 2, before this gasified fuel 15 is supplied to its place of utilization. The heat transfer from the energy-delivering hot gases 5 to the gasification mixture 11 can take place not only by direct radiant heat exchange, but optionally also by indirect radiant heat exchange with the participation of the wall of the reaction space 2, or by convective heat transfer between the reaction-space wall heated by radiation and the gasification mixture 11. The latter gives a portion of its heat in a heat-exchange process to primary air 13, the flow stream of which runs annularly with respect to the gasification mixture 11. This heated primary air 13*a*, having a temperature>500° C., then forms the combustion air for the premix burner 100. Use is therefore made of the following basic principles:

- radially stratified rotational stream with a low-density hot core and a high-density cooler outer stream.
- Staged combustion procedure in order to minimize the $NO_x$ emissions.
- Radiant heat exchange between substoichiometric hot core and reaction-space wall, or direct radiant heat exchange between hot core and gasification mixture.

This process, that is to say the gasified fuel 15 prepared, is preferably suitable as a fuel-preparation system for gas turbines, combined systems or heating/power stations With heavy oil as fuel, for example also with the addition of sludge. The process is also suitable for producing a synthesis gas in the chemical process manufacturing industry. It has the further advantage in comparison with the oxygen-blown gasification processes, that substantially smaller investment and operating costs are incurred.

Figure 2:
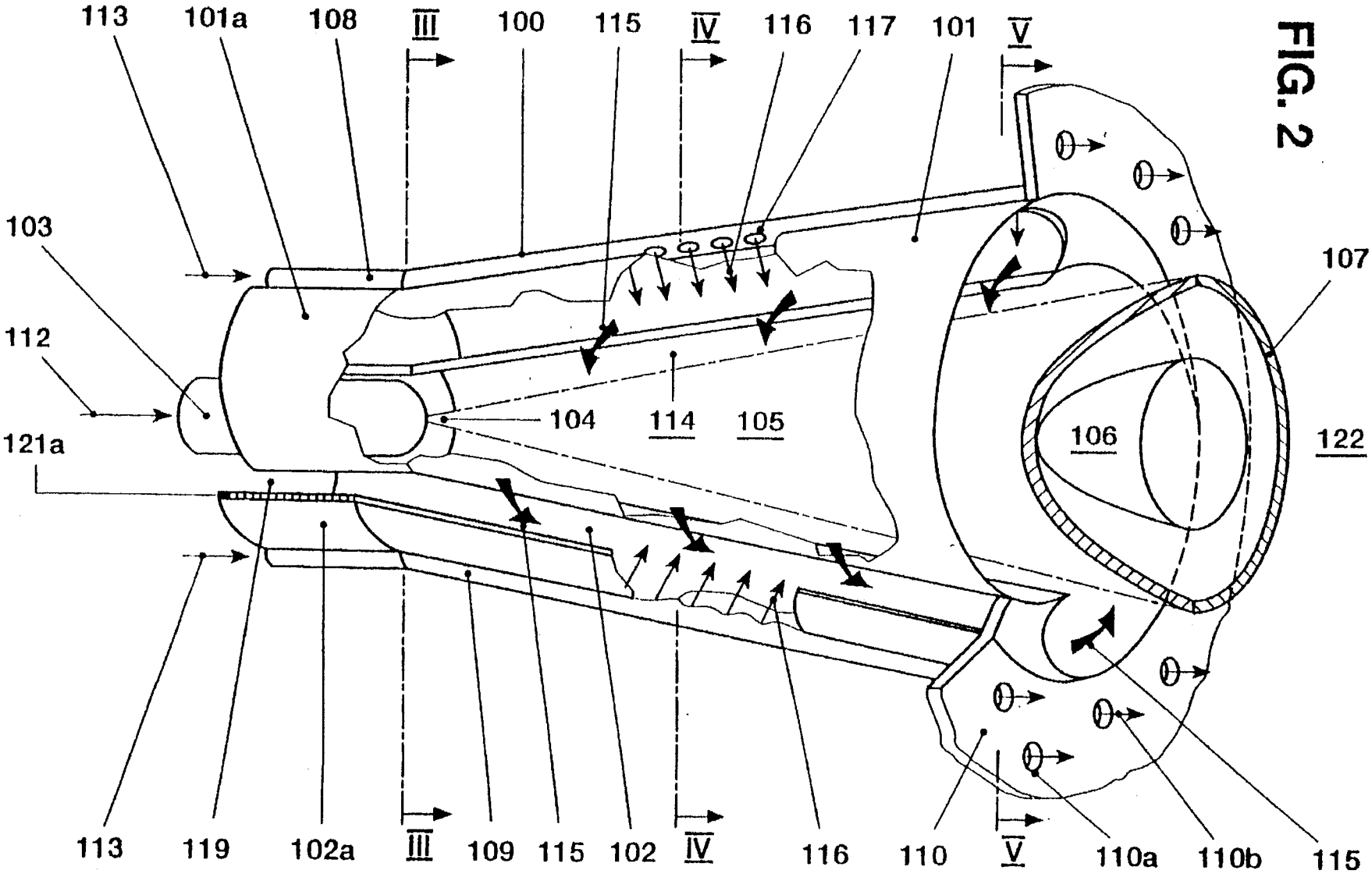
FIG. 2 shows a premix burner in the "double-cone burner" embodiment in perspective representation correspondingly sectioned.
Figure 3:
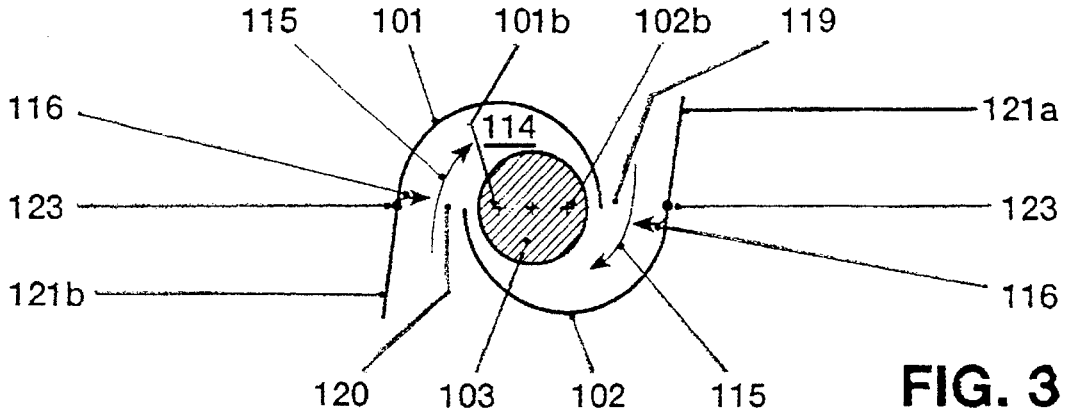
FIGS. 3 to 5 show sections through various planes of the premix burner according to FIG. 2.
Figure 4:
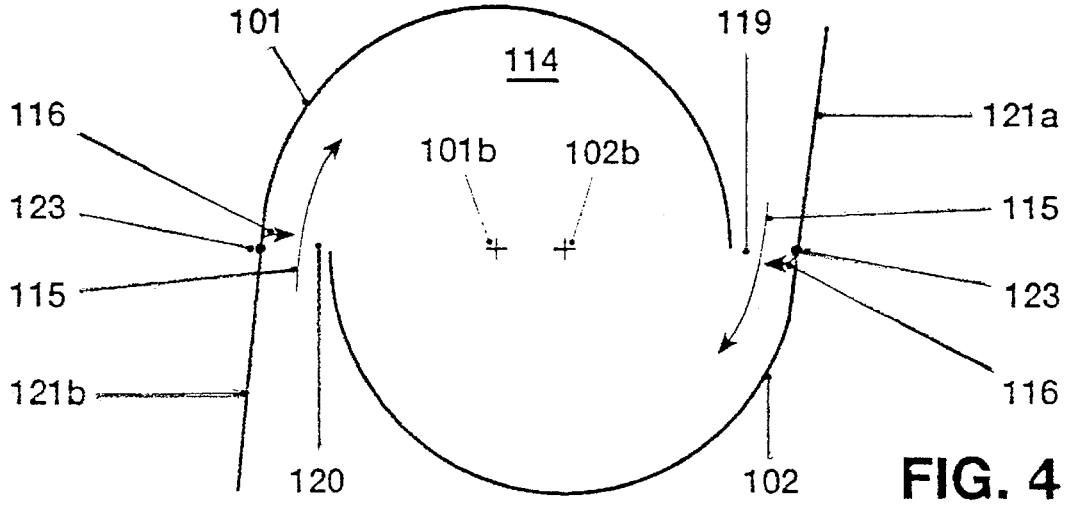
Figure 5:
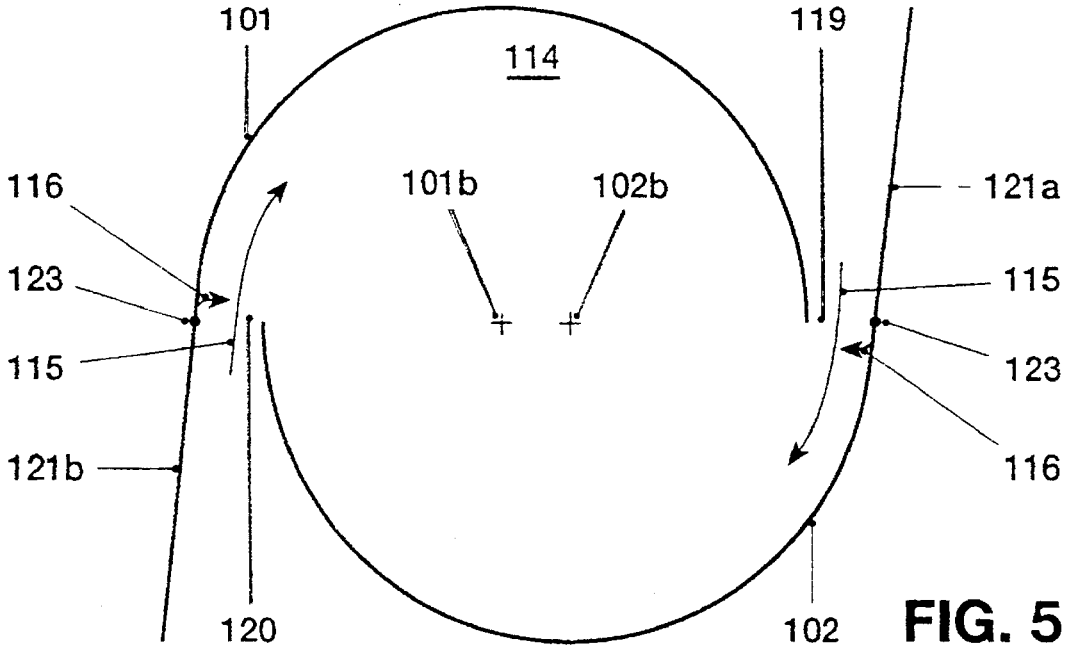

In order to better understand the construction of the burner 100, it is advantageous to refer to the individual sections according to FIGS. 3–5 at the same time as FIG. 2. Further, in order not to make FIG. 2 unnecessarily confusing, the guide plates 121*a*, 121*b* schematically shown according to FIGS. 3–5 have been included in FIG. 2 only by way of indication. In the description of FIG. 2 hereinbelow, reference will be made to the remaining FIGS. 3–5 as required.

The burner 100 according to FIG. 2 is a premix burner and consists of two hollow conical subcomponents 101, 102 which are fitted, mutually offset, in one another. The mutual offset of the respective mid-axis or longitudinal symmetry axes 101*b*, 102*b* of the conical subcomponents 101, 102 defines in each case, on both sides in mirror-image arrangement, a tangential air inlet slit 119, 120 (FIGS. 3–5), through which the combustion air 115 flows into the internal space of the burner 100, that is to say into the hollow conical space 114. The conical shape in the flow direction of the subcomponents 101, 102 shown has a specified fixed angle. Of course, according to each operational utilization, the subcomponents 101, 102 may have an increasing or decreasing conicity in the flow direction, similar to a trumpet or tulip, respectively. Representations of the latter two shapes are not included, since they are evident without further indication to the person skilled in the art. The two conical subcomponents 101, 102 each have a cylindrical initial part 101*a*, 102*a* which likewise, similarly to the conical subcomponents 101, 102, are mutually offset, so that the tangential air inlet slits 119, 120 are present over the entire length of the burner 100. A nozzle 103 is placed in the region of the cylindrical initial part, the injection 104 from which nozzle approximately coincides with the narrowest cross section of the hollow conical space 114 formed by the conical subcomponents 101, 102. The injection capacity and the type of this nozzle 103 depends on the predetermined parameters of the respective burner 100. Of course, the burner may be produced purely conically, i.e. with no cylindrical initial parts 101*a*, 102*a*. The conical subcomponents 101, 102 further each have a fuel line 108, 109 which are arranged along the tangential inlet slits 119, 120 and are provided with injection orifices 117 through which a preferably gaseous fuel 113 is injected into the combustion air 115 flowing therethrough, as the arrows 116 are intended to symbolize. These fuel lines 108, 109 are preferably placed at or before the end of the tangential inlet stream, before entry into the hollow conical space 114, this being in order to obtain optimum air/fuel mixing. On the combustion-space side 122, the outlet orifice of the burner 100 emerges in a front wall 110 in which a number of bores 110*a* are present. The latter are operated as required and serve to feed dilution air or cold air 110*b* to the front part of the combustion space 122. This air supply further serves for flame stabilization at the outlet of the burner 100. This flame stabilization is important whenever it is necessary to support the compactness of the flame following radial flattening. The fuel fed through the nozzle 103 is a liquid fuel 112 which, if need be, may be enriched with a fed-back exhaust gas. This fuel 112 is injected at an acute angle into the hollow conical space 114. A conical fuel profile 105 is consequently formed from the nozzle 103, which fuel profile is enclosed by the rotating combustion air 115 which flows in tangentially. The concentration of the fuel 112 is continuously reduced in the axial direction by the combustion air 115 which flows in to give optimum mixing. If the burner 100 is operated using a gaseous fuel 113, then introduction of the latter preferably takes place via orifice nozzles 117, formation of this fuel/air mixture taking place directly at the end of the air inlet slits 119, 120. When the fuel 112 is injected via the nozzle 103, the optimum, homogeneous fuel concentration is achieved over the cross section in the region of the vortex-flow site, that is to say in the region of the reverse flow zone 106 at the end of the burner 100. Ignition takes place at the tip of the reverse flow zone 106. Only at this location can a stable flame front 107 be produced. The risk of blow back of the flame into the interior of the burner 100, as is a possible case with known premix sections, against which assistance is sought using complicated flame holders, does not arise here. If the combustion air 115 is additionally preheated or enriched with a fed-back exhaust gas, then this continuously promotes evaporation of the liquid fuel 112 before the combustion zone is reached. The same considerations are also valid if, instead of gaseous, liquid fuels are fed via the lines 108, 109. In the design of the conical subcomponents 101, 102, tight limits are to be adhered to with regard to cone angle and width of the tangential air inlet slits 119, 120, in order for it to be possible for the desired flow field of the combustion air 115 with the flow zone 106 to be set up at the outlet of the burner. It should generally be stated that making the tangential air inlet slits 119, 120 smaller shifts the reverse flow zone 106 further upstream, although the mixture then consequently ignites earlier. In any case, it should be established that, once the reverse flow zone 106 is fixed, it is stable in its position, since the rotational speed increases in the flow direction in the region of the conical shape of the burner 100. The axial velocity within the burner 100 can be changed by a corresponding feed, not shown, of an axial combustion air flow. The design of the burner 100 is further preferably suitable for changing the size of the tangential air inlet slits 119, 120, by means of which a relatively wide operating range can be covered without altering the overall length of the burner 100.

The geometrical configuration of the guide plates 121*a*, 121*b* is now given by FIGS. 3–5. They have a flow introduction function and, corresponding to their length, they extend the respective end of the conical subcomponents 101, 102 in the inlet-flow direction with respect to the combustion air 115. The channeling of the combustion air 115 into the hollow conical space 114 can be optimized by opening or closing the guide plates 121*a*, 121*b* around a pivot point 123 placed in the region of the inlet of this channel into the hollow conical space 114, this being particularly necessary if the original gap size of the tangential air inlet slits 119, 120 is changed. These dynamic precautions may obviously also be provided in the steady state, in that tailored guide plates form a fixed component with the conical subcomponents 101, 102. The burner 100 can likewise also be operated without guide plates, or other auxiliary means may be provided for this purpose.

Obviously, numerous modifications and variations of the present invention are possible in light of the above teachings. It is therefore to be understood that within the scope of the appended claims, the invention may be practiced otherwise than is specifically described herein.

What is claimed as new and desired to be secured by Letters Patent of the United States is:

1. A process for air-blown gasification of carbon-containing fuels, comprising the steps of:

combusting a substoichiometric fuel/air mixture to produce a flow of heated gas;

directing the heated gas to flow as a core with rotating motion through a center of a reaction space in a first direction;

injecting a fuel into a superheated steam flow to produce a gasification mixture;

directing the gasification mixture to flow through the reaction space in a direction opposite to the heated gas flow to surround the heated gas, the gasification mixture being directed through swirlers to provide rotation in the gasification mixture flow, wherein the heated gas flow forms a relatively low density core stream and the gasification mixture forms a relatively high density annular outer stream, and wherein the gasification mixture is heated by radiant heat exchange with the heated gas to gasify the fuel.

2. The process as claimed in claim 1, further comprising the steps of:

adding secondary air to the heated gas after heat exchange with the gasification mixture for further combustion of the heated gas;

directing the further combusting heated gas through a flow space; and directing steam in a counterflow direction in heat transfer contact with the further combusting heated gas to superheat the steam for the gasification mixture.

3. The process as claimed in claim 1, comprising the step of heating primary air for the substoichiometric fuel/air mixture by heat exchange with an enclosing wall of the reaction space, the wall being heated by radiant heat transfer from the heated gas.

4. The process as claimed in claim 1, wherein radiant heat from the heated gas is reradiated from an enclosing wall of the flow space to the gasification mixture.

* * * * *